US010494942B2

(12) United States Patent
Albers et al.

(10) Patent No.: US 10,494,942 B2
(45) Date of Patent: Dec. 3, 2019

(54) INNER RING SYSTEM FOR AN INLET GUIDE VANE CASCADE OF A TURBOMACHINE

(71) Applicant: MTU Aero Engines AG, Munich (DE)

(72) Inventors: Lothar Albers, Munich (DE); Georg Zotz, Haimhausen (DE); Vitalis Mairhanser, Sigmertshausen (DE); Werner Humhauser, Moosburg (DE)

(73) Assignee: MTU Aero Engines AG, Munich (DE)

( * ) Notice: Subject to any disclaimer, the term of this patent is extended or adjusted under 35 U.S.C. 154(b) by 188 days.

(21) Appl. No.: 15/363,914

(22) Filed: Nov. 29, 2016

(65) Prior Publication Data

US 2017/0159470 A1 Jun. 8, 2017

(30) Foreign Application Priority Data

Dec. 4, 2015 (EP) ..... 15198116

(51) Int. Cl.
*F01D 11/00* (2006.01)
*F01D 17/16* (2006.01)

(52) U.S. Cl.
CPC ..... *F01D 11/003* (2013.01); *F01D 11/005* (2013.01); *F01D 17/162* (2013.01); *F01D 11/001* (2013.01); *F05D 2220/32* (2013.01); *F05D 2240/56* (2013.01); *F05D 2260/30* (2013.01)

(58) Field of Classification Search
CPC .... F01D 11/003; F01D 17/162; F01D 25/243; F01D 11/008; F01D 11/001; F01D 9/041; F01D 17/16; F01D 17/12; F01D 5/10; F01D 11/12; F05D 2240/56
See application file for complete search history.

(56) References Cited

U.S. PATENT DOCUMENTS 2,917,329 A * 12/1959 Laser ..... F16C 33/78 277/359
2,950,084 A * 8/1960 Perry ..... A41D 31/00 415/160
3,314,654 A 4/1967 Thenault et al.
(Continued)

FOREIGN PATENT DOCUMENTS

DE 102014205986 A1 10/2015
EP 1319844 B1 6/2003
EP 2261467 A2 12/2010
(Continued)

*Primary Examiner* — David E Sosnowski
*Assistant Examiner* — Maranatha Boardman
(74) *Attorney, Agent, or Firm* — Barlow, Josephs & Holmes, Ltd.

(57) ABSTRACT

The invention relates to an inner ring system for an inlet guide vane cascade of a turbomachine. The inner ring system comprises an intermediate casing for accommodating structural loads and an inner ring, which is divided axially into a first ring segment and a second ring segment, which together form recesses for bearing radially inner end portions of guide vanes of the inlet guide vane cascade, wherein at least the second ring segment is fixed in place on the intermediate casing by screw connection. The invention further relates to an inner ring and to an intermediate casing for such an inner ring system, as well as a turbomachine that has such an inner ring system.

14 Claims, 3 Drawing Sheets

(56) References Cited

U.S. PATENT DOCUMENTS

| | | | | |
|---|---|---|---|---|
| 5,114,159 | A * | 5/1992 | Baird | F01D 5/10 277/355 |
| 2014/0050564 | A1 * | 2/2014 | Hagan | F01D 11/001 415/116 |

FOREIGN PATENT DOCUMENTS

| | | | |
|---|---|---|---|
| EP | 2472066 | A1 | 7/2012 |
| EP | 2725200 | A1 | 4/2014 |
| WO | 2014046965 | A1 | 3/2014 |
| WO | 2015149732 | A2 | 10/2015 |

* cited by examiner

INNER RING SYSTEM FOR AN INLET GUIDE VANE CASCADE OF A TURBOMACHINE

BACKGROUND OF THE INVENTION

The invention relates to an inner ring system for an inlet guide vane cascade of a turbomachine. The invention further relates to an inner ring and an intermediate casing for such an inner ring system as well as a turbomachine with such an inner ring system.

Known from EP1 319 844 B1 is an inner ring or bearing ring for a guide vane cascade of a turbomachine. The inner ring is divided axially into a first ring segment and a second ring segment, which, in the mounted state, together form recesses for the mounting of vane roots of guide vanes of the guide vane cascade. For this purpose, the inner ring has a plurality of axial mounting boreholes or openings, by which the two ring segments are screwed together. The mounting of the inner ring occurs in a second stage of a compressor of the turbomachine, so that the inner ring is held by the guide vane cascade.

A drawback of the known inner ring is regarded as the circumstance that, in its mounted state in a turbomachine, it exhibits relatively low mechanical stability and can take up the loads that occur only to a very limited extent. As a result, the inner ring is not suitable, in particular, for an inlet guide vane cascade, that is, for a first stage of a compressor or of a turbine. A compressor or turbine is also understood to mean, in particular, a compressor module or a turbine module of the turbomachine. Here, under certain circumstances, especially high loads can occur, for example, due to impact of a bird. A compressor module can be, for example, a low-pressure compressor, a medium-pressure compressor, or a high-pressure compressor. This applies correspondingly to the turbine module, for which a low-pressure turbine or medium-pressure turbine or high-pressure turbine can be meant. In addition, owing to the relatively low mechanical stability, the relative positioning of the ring segments of the inner ring with respect to each other changes during operation of the associated turbomachine, this entailing, on the one hand, a deterioration of aerodynamic properties and, on the other hand, an increased wear in the region of the mounted vane roots. This high wear leads to correspondingly high maintenance costs.

SUMMARY OF THE INVENTION

The object of the present invention it to present an inner ring system for a first stage of a compressor or of a turbine, said inner ring system making possible improved aerodynamic properties and a lowering of maintenance costs. Further objects of the invention involve providing an inner ring and an intermediate casing for such an inner ring system as well as a turbomachine that has such an inner ring system.

The objects are achieved in accordance with the invention by an inner ring system, an inner ring and an intermediate casing for such an inner ring system, as well as by a turbomachine according to the present invention. Advantageous embodiments with appropriate enhancements of the invention are discussed in detail below, in which advantageous embodiments of each aspect of the invention are to be regarded as advantageous embodiments of each of the other aspects of the invention.

A first aspect of the invention relates to an inner ring system for an inlet guide vane cascade of a turbomachine. In accordance with the invention, the inner ring system comprises an intermediate casing for accommodating structural loads and an inner ring, which is divided axially into a first ring segment and a second ring segment, which together form recesses for mounting radially inner end portions of guide vanes of the guide vane cascade, wherein at least the second ring segment is fixed in place on the intermediate casing by screw connections. In this way, the inner ring system exhibits an especially high mechanical stability, because loads that occur during the operation of an associated turbomachine, which are transmitted via guide vanes, which are mounted in the recesses, to the ring segments of the inner ring, can be further transmitted onto the intermediate casing, which, as an element fixed to the machine, is appreciably better able to accommodate and distribute structural loads than is possible for the inner rings, which are borne exclusively by a guide vane cascade. In addition, owing to the screw connection of the inner ring to the intermediate casing, smaller relative movements due to tolerances or thermal movements between the two ring segments occur during the operation of the associated turbomachine. This leads to a better vane positioning and, as a result, to better aerodynamic properties, which cannot be realized without screw connections or only with latches or the like. Through the more precise and low-twist positioning of the guide vanes, the wear in the region of the guide vane roots is also reduced, as a result of which a corresponding reduction in maintenance costs can be achieved. The screw connection of the inner ring to the intermediate casing, which is also referred to as an IMC, additionally reduces or eliminates axial displacements during, for example, a bird impact.

Another advantage of the embodiment according to the invention with the two-part design of the inner ring lies in the possibility of a joint processing of the two ring segments. For example, the recesses for mounting the guide vane roots can be bored jointly. For this purpose, the two ring segments can be clamped together or fixed in position relative to each other by using an appropriate tool, after which the recesses can be appropriately bored in a precise manner. In this way, the recesses can be positioned more precisely, which, in conjunction with the screw connection of the inner ring to the intermediate casing, leads to additionally reduced relative movements due to tolerances or thermal movements between the two ring segments during operation. As a result, the vane positioning and hence the aerodynamic properties thereof can be additionally improved.

In an advantageous embodiment of the invention, it is provided that the first ring segment is to be arranged upstream with respect to a primary flow of the turbomachine, and the second ring segment is to be arranged downstream with respect to the primary flow. In other words, the first ring segment and the second ring segment are to be arranged axially separated and in succession in the flow direction. This facilitates the mounting and dismantling of the ring segments. In the process, it can be provided, in particular, that the first ring segment is arranged directly on the intermediate casing, whereas the second ring segment, in turn, lies downstream on the first ring segment.

Further advantages ensue in that the first ring segment and the second ring segment have a plurality of pairs of mutually flush mounting openings, through each of which a screw of the screw connections is guided to the intermediate casing. In this way, both the first ring segment and the second ring segment can be screwed together with the intermediate casing, which leads to an especially high mechanical stability. Moreover, the joint screw connection also improves a correct relative alignment of the two ring segments with respect to each other.

Alternatively, in another advantageous embodiment of the invention, it is provided that the first ring segment is float-mounted on the second ring segment and on the intermediate casing, and the second ring segment is screwed together with the intermediate casing, and/or that the first ring segment is supported against the second ring segment, the intermediate casing, and bearing elements of the guide vanes that are to be arranged in the recesses. In other words, in this embodiment, only the second ring segment is screwed together with the intermediate casing, whereas the first ring segment is float-mounted or fixed in place on the intermediate casing only indirectly via the second ring segment or is clamped to the intermediate casing. In this way, it is possible to create an especially compact construction design for geometrically small stages or for confined installation situations.

In another embodiment of the invention, it is provided that the first ring segment comprises a groove in which a projection of the second ring segment is arranged. During mounting, this simplifies the relative positioning of the two ring segments with respect to each other and, in the mounted state, additionally increases the mechanical stability of the inner ring. Preferably, the projection is not accommodated in the groove in a form-fitting manner, so as to allow thermally and/or mechanically caused relative movements, volume changes, etc., of the two ring segments.

Further advantages ensue when the first ring segment is sealed via a radially outer and/or via a radially inner sealing element, in particular an O-ring, against the intermediate casing and/or against the second ring segment. This improves the aerodynamic properties of the inner ring system and prevents flow losses during operation of the associated turbomachine, as a result of which appropriate increases in efficiency ensue. Preferably, the first ring segment and the second ring segment are designed with an appropriate radial seat in such a way that the first ring segment requires only one sealing element for the radially inner sealing or for the radially outer sealing, because, in this way, additional manufacturing and assembly costs will be saved.

In another advantageous embodiment of the invention, it is provided that the inner ring is screwed together with the intermediate casing from a downstream side and/or from an upstream side. This makes possible a high flexibility of design. Preferably, at least the second ring segment of the inner ring is screwed only from the downstream side, because this allows an advantageous and cost-effective mounting and dismantling of the inner ring without complete dismantling of the entire inner ring system or of the bearing housing.

In another advantageous embodiment of the invention, at least one of the ring segments comprises at least one holder for the arrangement of a brush seal. In other words, at least one ring segment, and preferably at least the second ring segment, is designed such that it bears a brush seal, wherein the brush seal is fastened to or can be fixed in place in the holder, for example, by mechanical clamping. By using a brush seal that is held to at least one of the ring segments, it is possible to realize an especially compact, lightweight, and efficient sealing of the inner ring system against a rotor of the associated turbomachine. As brush seal, it is fundamentally possible to provide all suitable types thereof. For example, a suitable brush seal comprises a brush seal housing, which is made of a metal support plate and a metal cover plate, which are joined to each other and together surround at least a brush head of the brush seal system in a U-shaped manner and ensure that it cannot drop out of the brush seal housing. The cover plate or the region of the two-part brush seal housing lying upstream in the flow direction is intended, first and foremost, to prevent interfering flow influences on a brush assembly protruding from the brush head and from the brush seal housing, whereas the support plate of the brush seal housing, which lies downstream as viewed in the direction of flow, serves to prevent a sagging of the brush assembly in the axial direction of the aircraft engine owing to the pressure difference above the brush seal housing.

In another advantageous embodiment of the invention, it is provided that, in the region of the holder, the first ring segment and/or the second ring segment comprise or comprises axial support of the brush seal. In this way, it is possible in a way that is simple in design to provide a stop for an element of the brush seal, for example, for the brush seal housing, as a result of which, on the one hand, the mounting of the brush seal is facilitated and, on the other hand, the ability of the brush seal to withstand loads is additionally increased.

In another advantageous embodiment of the invention, the first ring segment and the second ring segment are aligned via at least one alignment pin relative to each other and/or relative to a peripheral direction of the intermediate casing. As a result, it is possible in a way that is simple in design to ensure a further improvement in the positioning accuracy of the ring segments.

A second aspect of the invention relates to an inner ring for an inner ring system according to the first aspect of the invention. In this case, in accordance with the invention, the inner ring is divided axially into a first ring segment and a second ring segment, which, in the mounted state, together form recesses for mounting radially inner end portions of guide vanes of the inlet guide vane cascade, wherein, at least the second ring segment has mounting openings for screwing together with the intermediate casing of the inner ring system. In this way, the inner ring makes possible improved aerodynamic properties as well as a lowering of the maintenance costs of the inner ring system. Fundamentally, it is possible to also provide that only the second ring segment comprises mounting openings or that both the first ring segment and the second ring segment have mounting openings for joint screwing together with the intermediate casing. Further features and the advantages thereof may be taken from the descriptions of the first aspect of the invention, with advantageous embodiments of the first aspect of the invention to be regarded as advantageous embodiments of the second aspect of the invention. Conversely, advantageous embodiments of the second aspect of the invention are also to be regarded as advantageous embodiments of the first aspect of the invention.

A third aspect of the invention relates to an intermediate casing for an inner ring system according to the first aspect of the invention. In this case, in accordance with the invention, it is provided that the intermediate casing comprises mounting openings for the screw connection of at least the second ring segment of the inner ring of the inner ring system. In this way, the intermediate casing makes possible improved aerodynamic properties as well as a lowering of maintenance costs of the inner ring system. Further features and the advantages thereof may be taken from the descriptions of the first aspect of the invention and the second aspect of the invention, with advantageous embodiments of the first aspect of the invention and the second aspect of the invention to be regarded as advantageous embodiments of the third aspect of the invention. Conversely, advantageous embodiments of the third aspect of the invention are also to be regarded as advantageous embodiments of the first aspect of the invention and the second aspect of the invention.

A fourth aspect of the invention relates to a turbomachine, in particular an aircraft engine. In accordance with the invention, the turbomachine comprises an inner ring system according to the first aspect of the invention and an inlet guide vane cascade, which has a plurality of guide vanes, which, in relation to a longitudinal axis of the cascade, each comprise a radially outer end portion and a radially inner end portion, wherein the radially inner end portions of the guide vanes are arranged in the recesses formed jointly by the first ring segment and the second ring segment. In this way, the turbomachine has improved aerodynamic properties and can be serviced with lower costs. In this case, the guide vanes of the inlet guide vane cascade are referred to as IGV (inlet guide vanes), whereas their radially inner end portions may also be referred to as vane roots. Further features and the advantages thereof may be taken from the descriptions of the first, second, and third aspects of the invention, with advantageous embodiments of the first, second, and the third aspects of the invention to be regarded as advantageous embodiments of the fourth aspect of the invention, and vice versa.

In another advantageous embodiment of the invention, it is provided that the guide vanes are adjustable and/or that the radially inner end portions of the guide vanes are held in the recesses via bearing bushings. Owing to the screw connection of the inner ring to the intermediate casing, the guide vanes, designed as distribution guide vanes, are mounted in an especially mechanically stable manner in the region of their vane root (e.g., inner pin or vane plate), as a result of which, besides an improvement in the mechanical and aerodynamic properties, also the vibrational load on the guide vanes is substantially reduced. The bearing bushings can be clamped in the recesses, for example. By using bearing bushings, it is possible to improve advantageously the bearing, sealing, and mounting of the guide vanes. On account of the lower relative movements of the rings segments due to the screw connection of the inner ring, the bearing bushings are, in addition, subjected to substantially less wear.

Further advantages ensue in that the inner ring system and the inlet guide vane cascade are part of a low-pressure compressor stage and/or a medium-pressure compressor stage and/or a high-pressure compressor stage and/or a high-pressure turbine stage and/or a medium-pressure turbine stage and/or a low-pressure turbine stage of the turbomachine. In other words, the inner ring system is part of a first stage of a low-pressure, medium-pressure, and/or high-pressure compressor or of a low-pressure, medium-pressure, and/or high-pressure turbine of the turbomachine. In this way, the advantageous properties of the inner ring system can be realized for differently designed types of turbomachines or at different points within the turbomachine.

BRIEF DESCRIPTION OF THE DRAWING FIGURES

Further features of the invention ensue from the claims and the exemplary embodiments. The features and combinations of features mentioned in the above description as well as the features and combinations of features mentioned below in the exemplary embodiments and/or shown alone can be used not only in the respectively given combination, but also in other combinations or alone, without departing from the scope of the invention. Accordingly, embodiments of the invention that are not explicitly shown and explained in the exemplary embodiments, but can arise from or be produced through separate combinations of features from the explained embodiments, are also included and are to be regarded as disclosed. Hence, embodiments and combinations of features that accordingly do not have all features of an originally formulated independent claim are also to be regarded as disclosed. Herein:

DESCRIPTION OF THE INVENTION

Figure 1:
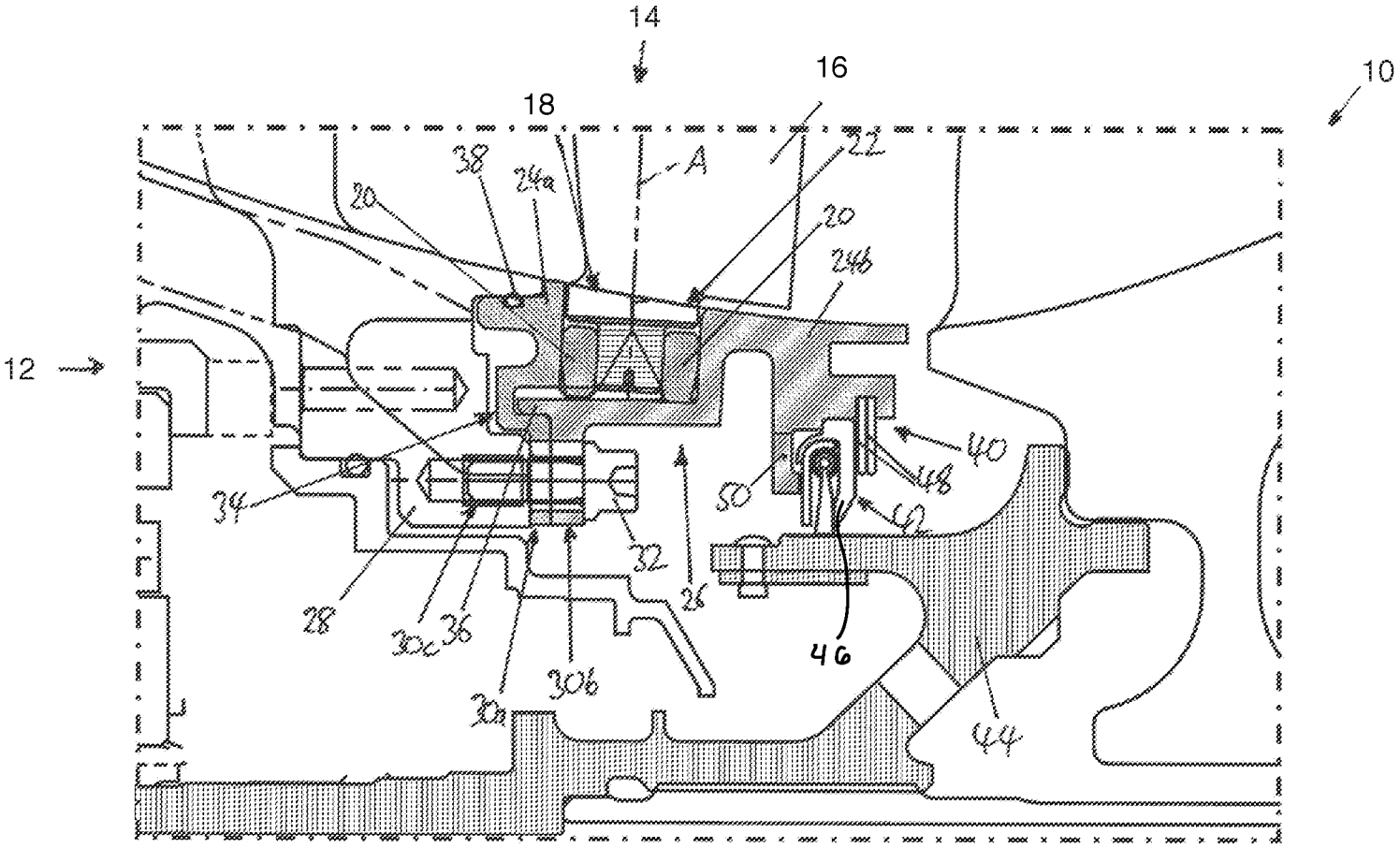
FIG. 1 shows a schematic excerpt of a turbomachine according to the invention in the region of a first stage of a compressor.

FIG. 1 shows a schematic excerpt of a turbomachine 10 according to the invention in the region of a first stage of a compressor 12. The turbomachine 10 is designed as an aircraft engine in the present case. The compressor 12, which can be a one-stage or multistage low-pressure, medium-pressure, or high-pressure compressor, for example, comprises, as first stage, an inlet guide vane cascade 14, which has a plurality of guide vanes 16 (inlet guide vanes, IGV), which, in relation to a cascade longitudinal axis A, each comprise a radially outer end portion (not shown) and a radially inner end portion 18, and the end portion 18 may also be referred to as a vane root. The radially inner end portions 18 of the guide vanes 16 are arranged, together with their respective bearing bushings 20, in recesses 22. The recesses 22 are formed jointly by a first ring segment 24*a* and a second ring system 24*b* of an axially divided inner ring 26. In the present exemplary embodiment, the first ring segment 24*a* is arranged upstream with respect to a primary flow of the turbomachine 10 and the second ring segment 24*b* is arranged downstream with respect to the primary flow. For improvement of the mechanical and aerodynamic properties, the inner ring 26 is screwed together with an intermediate casing 28 (IMC) for taking up structural loads. To this end, in the present exemplary embodiment, the first ring segment 24*a* and the second ring segment 24*b* have a plurality of pairs of mutually flush mounting openings 30*a*, 30*b* distributed over the periphery of the intermediate casing 28, through each of which a screw 32 is guided to the intermediate casing 28 and screwed into a corresponding mounting opening 30*c* of the intermediate casing 28, which is furnished with a thread in the present case. Alternatively, it is also possible to provide other types of fastening, such as, for example, locknuts, or the like. In the present case, the screw connection occurs from the downstream side of the inner ring 26. Advantageously, this makes possible the dismantling of the ring segments 24*a*, 24*b* without complete dismantling of the entire bearing structure.

It can be seen that the first ring segment 24*a* in the exemplary embodiment shown comprises a groove 34, in which a projection 36 of the second ring segment 24*b* is arranged with play. In this way, the ability of the second ring segment 24*b* to move with respect to the first ring segment 24*a* is limited, as a result of which the mechanical stability is increased and the mounting of the inner ring 26 is facilitated. The first ring segment 24*a* is sealed against the intermediate casing 28 via a radially outer sealing element 38, designed as an O-ring in the present case. A radially lower seal can be dispensed with, because the sealing occurs for the air system via the radial seat between the front and back ring segments 24*a*, 24*b*. Dispensing with a seal leads to lower costs, both in manufacture and in maintenance of the turbomachine 10.

The second ring segment 24*b* further comprises a holder 40 in the region of its downstream end, in which a brush seal 42 is mounted, via which a sealing of the inner ring 26 against a rotor 44 of the compressor 12 is achieved. The brush seal 42 comprises a brush seal housing 46, which is fixed in place via two clamping plates 48 in the holder 40. Furthermore, in the region of the holder 40, the second ring segment 24*b* comprises a stop 50 for axial support of the brush seal 42.

For relative alignment, the first ring segment and the second ring segment, 24*a*, 24*b*, can be aligned relative to each other or relative to the peripheral direction of the intermediate casing 28 via at least one alignment pin (not shown).

Through the more precise positioning of the mounting boreholes 30*a-c* and thus also the bearing bushings 20, the bushing wear is reduced. Less wear also results in a reduction in maintenance costs. The more precise positioning and a lower bushing wear also lead to an improved positioning of the guide vanes 16 during operation and hence to improved aerodynamics.

Figure 2:
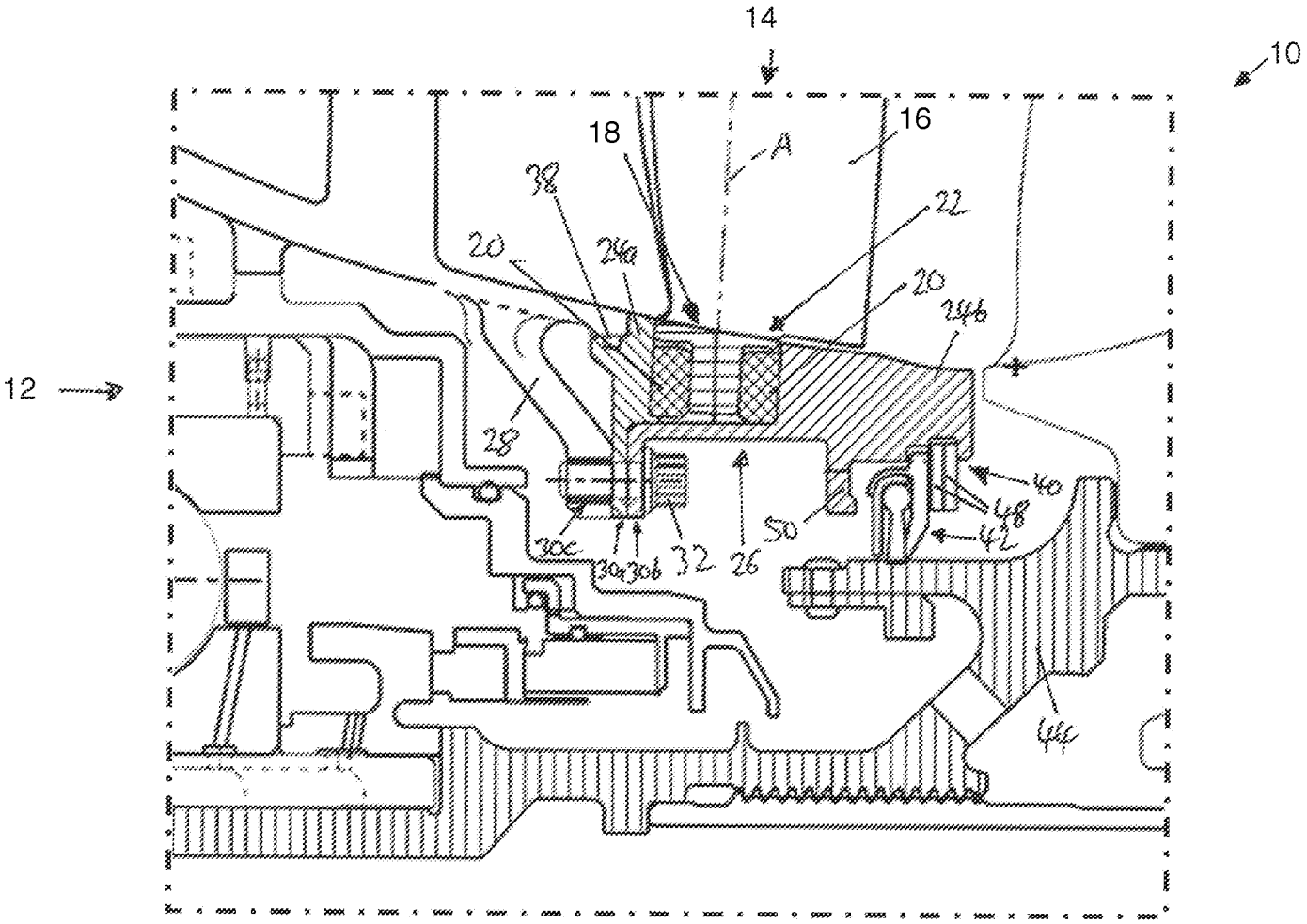
FIG. 2 shows a schematic excerpt of an alternative embodiment of the turbomachine according to the invention in the region of a first stage of a compressor.

FIG. 2 shows a schematic excerpt of an alternative embodiment of the turbomachine 10 according to the invention in the region of a first stage of a compressor 12. In this case, the basic design corresponds to that discussed in connection with FIG. 1. In contrast to the preceding exemplary embodiment, the first ring segment 24*a* does not have a groove 34 or a depression. Accordingly, the second ring segment 24*b* also does not have a projection 36.

Figure 3:
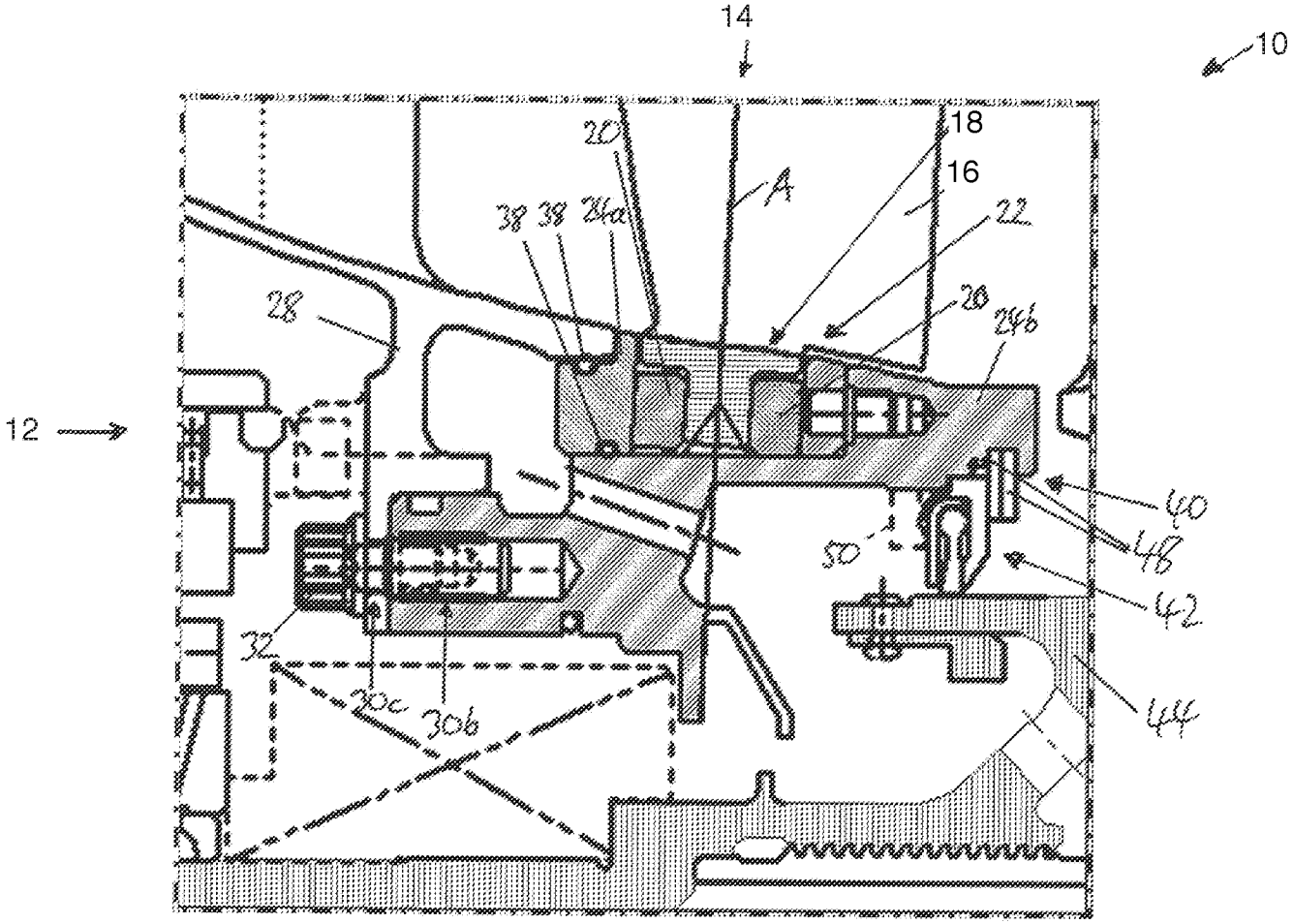
FIG. 3 shows a schematic excerpt of another alternative embodiment of the turbomachine according to the invention in the region of a first stage of a compressor.

FIG. 3 shows a schematic excerpt of another alternative embodiment of the turbomachine 10 according to the invention in the region of a first stage of a compressor 12. It can be seen that, in the present example, the inner ring 26 is screwed together with the intermediate casing 28 only via the second ring segment 24*b*. By contrast, the first ring segment 24*a* is float-mounted and secured in position via the screw-connected second ring segment 24*b*, the bearing bushing 20, the vane root 18, and the intermediate casing 28. In contrast to the preceding exemplary embodiments, the screwing of the second ring segment 24*a* together with the intermediate casing 28 occurs from the upstream side of the inner ring 26, so that the second ring segment 24*b* has a corresponding inner thread in its mounting opening 30*b*. For sealing, the first ring segment 24*a* has a radially upper and radially lower sealing element 38, each of which is formed as an O-ring. The fundamentally optional stop 50 is illustrated as a dashed line.

What is claimed is:

1. An inner ring system for an inlet guide vane cascade of a turbomachine, comprising:

an intermediate casing for accommodating structural loads; and an inner ring, which is divided axially into a first ring segment and a second ring segment, which together form recesses for bearing radially inner end portions of guide vanes of the inlet guide vane cascade, wherein each guide vane has a length;

wherein at least the second ring segment is fixed in place on the intermediate casing by screw connections, wherein the first ring segment supports a first side of the radially inner end portions of the guide vanes and the second ring segment supports a second side of the radially inner end portion of the guide vanes, the first side and the second side are axially offset from one another, wherein the first ring segment and the second ring segment supports the respective sides of the radially inner end portion of the guide vanes at least partially at the same location along the length of the guide vane, and wherein the first ring segment is sealed via a radially outer and/or via a radially inner sealing element against the intermediate casing and/or against the second ring segment.

2. The inner ring system according to claim 1, wherein the first ring segment is arranged upstream with respect to a primary flow of the turbomachine, and the second ring segment is arranged downstream with respect to the primary flow.

3. The inner ring system according to claim 1, wherein the first ring segment and the second ring segment have a plurality of pairs of mutually flush mounting openings, through each of which a screw of the screw connections is guided to the intermediate casing.

4. The inner ring system according to claim 1, wherein the first ring segment is float-mounted on the second ring segment and on the intermediate casing, and the second ring segment is screwed together with the intermediate casing, and/or that the first ring segment is supported on the second ring segment, on the intermediate casing, and on a bearing element of the guide vanes arranged in the recesses.

5. The inner ring system according to claim 1, wherein the first ring segment comprises a groove, in which a projection of the second ring segment is arranged.

6. The inner ring system according to claim 1, wherein the inner ring is screwed together with the intermediate casing from a downstream side and/or from an upstream side.

7. The inner ring system according to claim 1, wherein at least one of the ring segments comprises at least one holder for the arrangement of a brush seal.

8. The inner ring system according to claim 7, wherein the first ring segment and/or the second ring segment comprises, in the region of the holder, an axial support of the brush seal.

9. The inner ring system according to claim 1, wherein the first ring segment and the second ring segment are aligned relative to each other and/or relative to a peripheral direction of the intermediate casing via at least one alignment pin.

10. The inner ring system according to claim 1, wherein the first ring segment and the second ring segment, which, in the mounted state, together form recesses for bearing radially inner end portions of guide vanes of the inlet guide vane cascade, wherein at least the second ring segment has mounting openings for screwing together with the intermediate casing of the inner ring system.

11. The inner ring system according to claim 1, wherein the intermediate casing comprises mounting openings for the screw connection of at least the second ring segment of the inner ring of the inner ring system.

12. The inner ring system according to claim 1, wherein the inner ring system is configured and arranged in a turbomachine, the turbomachine includes an inlet guide vane cascade having a plurality of guide vanes, which, in relation to a cascade longitudinal axis, each comprise a radial outer and a radial inner end portion, wherein the radial inner end portions of the guide vanes are arranged in the recesses formed jointly by the first ring segment and the second ring segment of the inner ring.

13. The inner ring system according to claim 12, wherein the guide vanes are adjustable and/or in that the radially inner end portions of the guide vanes are held in the recesses via bearing bushings.

14. The inner ring system according to claim 12, wherein the inner ring system and the inlet guide vane cascade are part of a low-pressure compressor stage and/or a medium-pressure compressor stage and/or or high-pressure compressor stage and/or a high-pressure turbine stage and/or a medium-pressure turbine stage and/or a low-pressure turbine stage of the turbomachine.

* * * * *